US005158014A

United States Patent [19]

Hengstenberg

[11] Patent Number: 5,158,014

[45] Date of Patent: Oct. 27, 1992

[54] ARRANGEMENT FOR APPORTIONING AND DISPENSING FIBROUS GOODS, PARTICULARLY SAUERKRAUT

[75] Inventor: Eckart Hengstenberg, Esslingen, Fed. Rep. of Germany

[73] Assignee: Rich, Hengstenberg GmbH & Co., Fed. Rep. of Germany

[21] Appl. No.: 730,163

[22] Filed: Jul. 16, 1991

Related U.S. Application Data

[63] Continuation-in-part of Ser. No. 461,254, Jan. 5, 1990, abandoned.

[51] Int. Cl.[5] ..... B30B 9/24

[52] U.S. Cl. ..... 100/74; 99/495; 99/535; 100/95; 100/118; 100/152; 210/401

[58] Field of Search ..... 100/73, 74, 94–97, 100/116, 118, 119, 120, 151, 152, 154, 104; 210/386, 400, 401; 99/495, 535, 537; 162/194, 286

[56] References Cited

U.S. PATENT DOCUMENTS

| | | | |
|---|---|---|---|
| 1,315,924 | 9/1919 | Fuller | 162/286 |
| 2,652,769 | 9/1953 | Wehr | 100/154 X |
| 4,236,445 | 12/1980 | Sernagiotto et al. | 100/118 |
| 4,328,743 | 5/1982 | Fager | 100/118 X |
| 4,395,331 | 7/1983 | Andersson | 100/118 X |
| 4,643,088 | 2/1987 | Kollmar | 100/118 X |
| 4,665,811 | 5/1987 | Meyer | 99/535 X |
| 4,911,788 | 3/1990 | Pittman et al. | 162/194 X |

FOREIGN PATENT DOCUMENTS

| | | | |
|---|---|---|---|
| 1461977 | 1/1969 | Fed. Rep. of Germany . | |
| 3447509 | 8/1985 | Fed. Rep. of Germany . | |
| 3503242 | 8/1986 | Fed. Rep. of Germany . | |
| 3823360 | 1/1990 | Fed. Rep. of Germany . | |
| 2542857 | 9/1984 | France . | |
| 2591911 | 6/1987 | France . | |
| 61-11200 | 1/1986 | Japan | 100/118 |

*Primary Examiner*—Harvey C. Hornsby
*Assistant Examiner*—Stephen F. Gerrity
*Attorney, Agent, or Firm*—Evenson, Wands, Edwards, Lenahan & McKeown

[57] ABSTRACT

An apparatus for the apportioning and dispensing of fibrous goods, particularly of sauerkraut, is disclosed. The apparatus for the dispensing of fibrous goods which are first mixed with a liquid ensures a precise maintaining of a certain weight of the goods which are drained by the apparatus. According to the invention, it is suggested to provide sieve walls in the form of travelling sieve belts between which a progressively drained strand of fibrous goods is formed. The strand can then be cut into portions. The new apparatus may be used for the apportioning of sauerkraut.

13 Claims, 5 Drawing Sheets

ARRANGEMENT FOR APPORTIONING AND DISPENSING FIBROUS GOODS, PARTICULARLY SAUERKRAUT

BACKGROUND AND SUMMARY OF THE INVENTION

This application is a continuation in part of U.S. patent application Ser. No. 07/461,254 filed on Jan. 5, 1990 (now abandoned).

The invention relates to a process and an arrangement for the apportioning and dispensing of fibrous goods, particularly of sauerkraut, in which the fibrous goods are first mixed with a liquid and, together with this liquid, are conveyed between sieve walls and are drained there for the purpose of forming an apportionable mass.

A process and an arrangement is known for the dispensing of sauerkraut in bags (Bag Forming, Filling, and Sealing Machine SVS 25/15 of the firm Hassia Verpackung GmbH, D-6479 Ranstadt, Germany), in which sauerkraut is mixed with fresh juice and is then pumped into perforated cylinders where a draining takes place by the application of a vacuum before the slug formed in the perforated cylinders is pressed into the packaging bag by means of an ejector. This type of a dispensing process makes it possible to bring relatively precise quantities of the brine/sauerkraut mixture into the cylinders. The quantity which is to be dispensed into the bag later and mainly the weight of the sauerkraut slug, however, depends significantly on maintaining the precise mixture ratio of the sauerkraut and the juice. The weight of the slug, however, also depends on the consistency of the sauerkraut to be packaged which also has an influence on the amount of sauerkraut which arrives in the perforated cylinders. Finally. because the vacuum is applied outside the perforated cylinders, there is also the danger that parts of the sauerkraut are pulled into the openings of the sieve walls and are then cut off by force during the ejection and which, when the operation lasts for some time, may also result in a clogging of the perforated cylinders.

Nevertheless, the initially mentioned process, in which a sauerkraut/brine mixture is used, compared to all other known dispensing processes in which conveyor worms and the like are used, for example, has the advantage that the supply of brine is constant with respect to quantity so that disadvantages are avoided completely which may occur, for example, during the mechanical feeding of sauerkraut by way of worm conveyors as a result of occurring hollow spaces.

Also known are devices for pressing liquid out of material containing liquid, such as fruits. One such device is described in U.S. Pat. No. 4,395,331 in which as much water as possible is to be pressed from the starting material. With this apparatus, only approximately 10% to 20% of the liquid originally contained in the fruit remains in the final product.

An object of the present invention is to further improve a process and an arrangement of the first mentioned type in order to achieve a dispensing in which also the weight of the amount to be dispensed may be kept constant without any large expenditures. The product to be processed is not to be pressed, so as to maintain a high percentage of liquid in the final product.

In order to achieve this objective, it is suggested in a process of the initially mentioned type to move the sieve walls continuously along in the direction of the supplied liquid/ product mixture so that they enclose between one another the progressively drained strand of the fibrous goods and then lead it to a station at which the moving strand is cut off in portions. This process has the significant advantage that it is not important that the mixture ratio between the brine and the sauerkraut or the red cabbage, blanched vegetable or the like must be kept absolutely constant in order to achieve the required weight quantity during the apportioning. The reason is that the strand of fibrous goods to be cut off is formed more or less mechanically by the forced conveying between sieve walls, and the apportioning or cutting-off of the strand will not take place before an area of the conveying segment between the sieve walls in which a largely homogeneous and dense strand has formed with certain geometrical dimensions which is ensured by the guiding between the sieve walls. Thus, when a certain length is cut off from this strand in each case, it is also ensured that the cut-off part has a certain weight. By the combination of the feeding of fibrous goods in a liquid and the drainage between a moving perforated-wall segment, i.e., a mechanical advancing segment, the advantage is therefore achieved of an apportioning which can be precisely controlled with respect to weight and which was not possible by means of the previously known processes.

The new process can be carried out advantageously and easily by means of an arrangement which, in a manner known per se, is equipped with a device for mixing the fibrous goods with a liquid as well as with pumping and guiding devices conveying the liquid enriched with the fibrous goods to a draining device equipped with a sieve arrangement and in which, in a novel way, the sieve arrangement is formed by at least two opposite, synchronously moving, continuous sieve belts, the ends of these belts which face one another and move in the same direction forming a gap having a substantially constant width which is connected on the inlet side to a connecting piece of the conveying line and is connected at the outlet side end to a cutting device for the strand formed between the sieve belts. This strand contains at least 50% of the liquid that had been mixed with the fibrous goods. This type of an arrangement can be implemented relatively easily. It was found that it furnishes excellent results. It is also advantageous that the quantity to be processed is relatively high so that a few of such arrangements are sufficient for loading several filling devices for dispensing goods to cans and bags.

It was found to be particularly advantageous for the axes of the deflecting belts of the continuous sieve belts and thus also the ends of the sieve belts which face one another to be arranged vertically and for the ends to move in a rectangular guide duct with sieve walls. As a result, a stable support is obtained for the ends of the sieve belts toward the outside and thus also a precisely maintainable geometry of the forming strand which, in turn, has the result that, when certain strand lengths are cut off, the weight amount of the goods to be dispensed is also constant.

Expediently according to certain preferred embodiments, the guide duct is arranged in a vat which is mounted under a bearing plate receiving the bearing for the deflecting rollers of the sieve belts and their drive. If the vat is provided with a drain, the brine can be returned in a recirculating operation for further use into the operation in the case of a new process.

In order to achieve the desired driving of the two sieve belts in opposite directions, a motor may be provided in a simple manner which, by way of a transmission, drives the shafts of one of the deflecting rollers of the two belts respectively at the same rotational speed but in opposite directions. Finally, a tension roller may be assigned to each continuous sieve belt by means of which the precise circulation is ensured. The driving speed of the sieve belts determines the ejection of the new device which naturally should be coordinated with the fed mixture of brine and sauerkraut or the like. It was found, however, that irregularities in the mixture ratio between the fibrous goods and the brine or in the feeding quantity do not exercise any significant influence on the quality of the strand formation. The border between the strands which becomes progressively more compact and the mixture phase consisting of the liquid and the fibrous goods inside the moving sieve belts therefore only shifts to one side or the other.

Other objects, advantages and novel features of the present invention will become apparent from the following detailed description of the invention when considered in conjunction with the accompanying drawings.

DETAILED DESCRIPTION OF THE DRAWINGS

Figure 1:
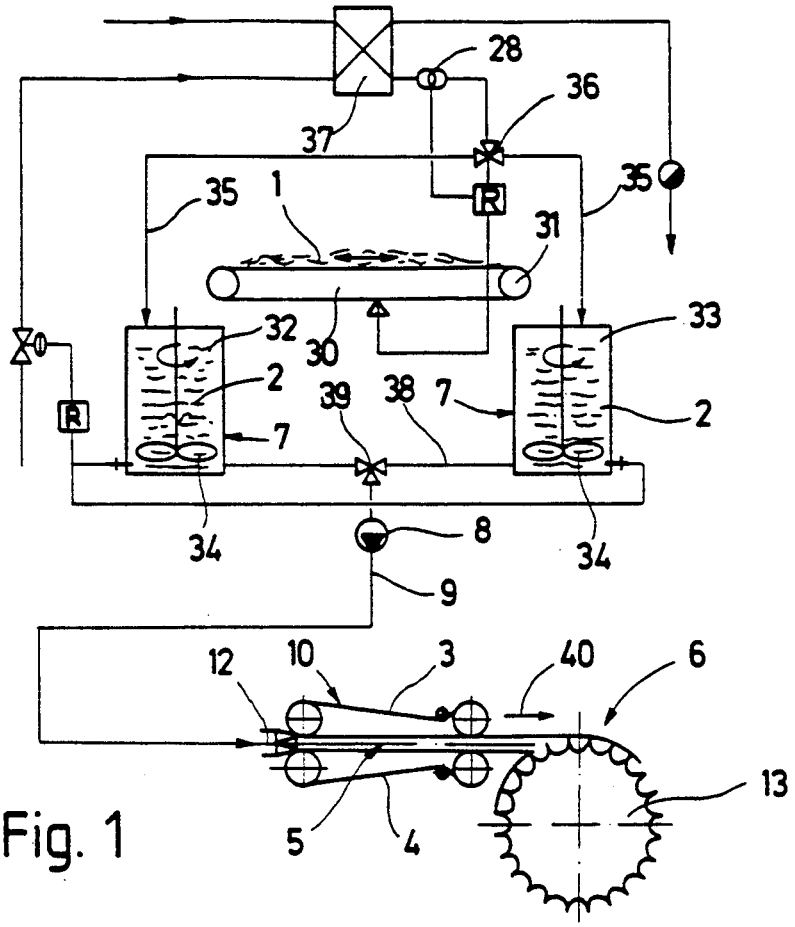
FIG. 1 is a schematic representation of an arrangement by means of which the process according to the invention for the dispensing of sauerkraut can be carried out.

In FIG. 1, sauerkraut 1, in a manner not shown in detail, is moved onto a scale 30 which is equipped with a conveyor belt 31 and which feeds respective weighed amounts of the sauerkraut toward the left or the right into receptacles 32 and 33 which are equipped with a stirring device 34. A liquid, such as sauerkraut brine in the case of the embodiment shown, is fed into these receptacles 32 and 33 by way of pipes 35. The amount of the brine being determined as a function of the amount of sauerkraut fed into the receptacles 32 and 33 by means of a measuring device 28 and by way of a control valve 36, such that the sauerkraut/brine mixture is approximately 1:3. Beforehand, the brine which is guided through the pipes 35 may be brought to a certain temperature in a heat exchanger 37.

From the two receptacles, the sauerkraut/brine mixture is now brought into a conveying pipe 9 by way of a pipe 38 having a control valve 39 and a pump 8. Conveying pipe 9 leads into a draining device 10 by means of a connection piece 12. Conveying device 10 consists essentially of two circulating continuous sieve belts 3 and 4. These sieve belts 3 and 4 are parallel such that they extend in relation to each other at a substantially constant width of, for example, 6 cm wide. Their mesh width is approximately, for example, 1.5×1.5 mm. In this case, the sieve belts 3 and 4 circulate such that their ends 3*a*, 4*a* which face one another (see FIG. 2) move in the direction of the fed sauerkraut/brine mixture. The brine drains in the area between the sieve belts 3 and 4 so that a strand 5 of drained sauerkraut forms between the two ends 3*a*, 4*a* which face one another, this drained strand of sauerkraut being mechanically conveyed by the circulating sieve belts 3, 4 in the direction of the arrow 40 to a cutting device 6 by means of which certain lengths of the strand 5 are cut off, and the cut-off strand parts are then dispensed into cans or bags in a manner not shown in detail. In this case, the driving speed of the sieve belts 3, 4 is coordinated with the fed sauerkraut/brine mixture such that, after an equilibrium occurs, the border area between a forming firm strand 5 and the still largely liquid phase in the inlet area is always located between the moving belt ends 3*a*, 4*a* of the sieve belts 3, 4.

Figure 2:
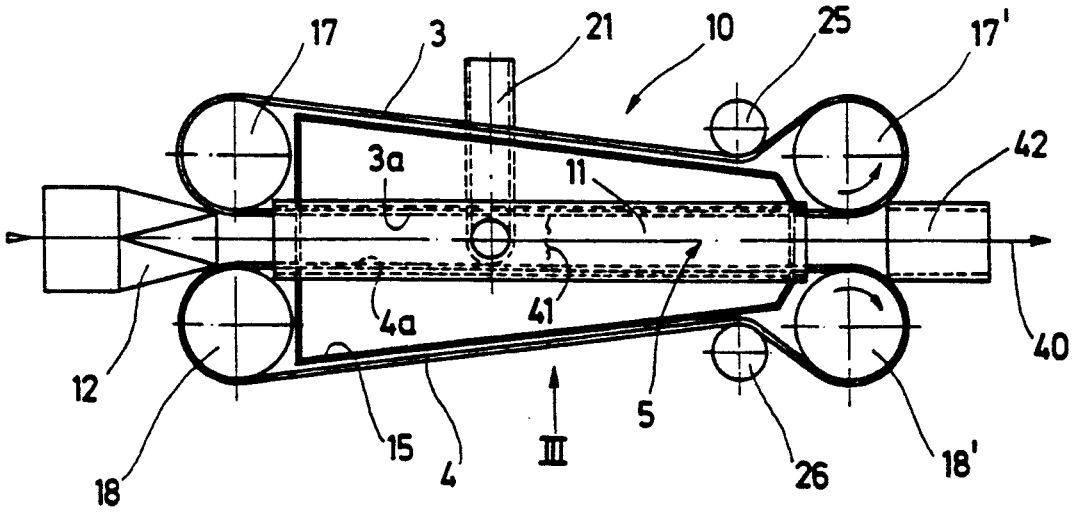
FIG. 2 is an enlarged top view similar to FIG. 1 of the core piece for the new process which, in FIG. 1, is shown as part of the overall installation, in which case, the covering and the driving arrangement are left out.

After this has occurred, a strand 5 is formed, for example, approximately starting in the border area 41 shown schematically in FIG. 2, in the gap 11 between the belt ends 3*a* and 4*a* of the sieve belts 3 and 4 facing one another, this strand 5 becoming progressively dryer and thus firmer and consisting of sauerkraut parts which rest closely against one another. After leaving the gap 11, the strand reaches a guide 42 and is mechanically pushed by means of the circulating sieve belts 3, 4 to the cut-off device schematically shown in FIG. 1, where certain lengths of the strand are cut off and then processed further.

It is easily recognizable in this case that the position of the border area 41 between the firm strand 5 and the largely liquid phase may definitely shift inside the gap if, for example, the mixture ratio between the kraut and the brine is subjected to certain fluctuations, or if the respective fed amount fluctuates within certain limits. However, this has no influence on the formation of the strand 5 which, at least when it comes out of the gap 11, always has the same consistency and therefore, if it has the same geometrical dimensions, may also be utilized for always cutting off the same amounts which, also because of the achievable homogeneity of the strand, always have the same weight.

Figure 4:
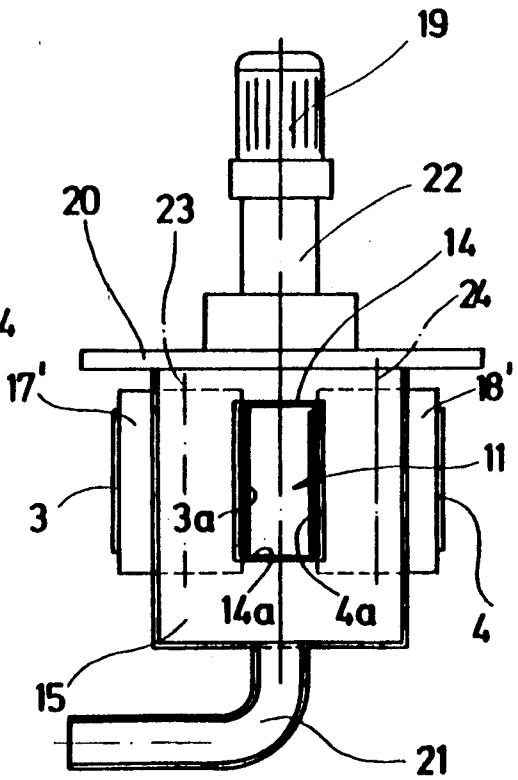
FIG. 4 is a sectional view of the device according to FIG. 3 along Line IV—IV.
Figure 3:
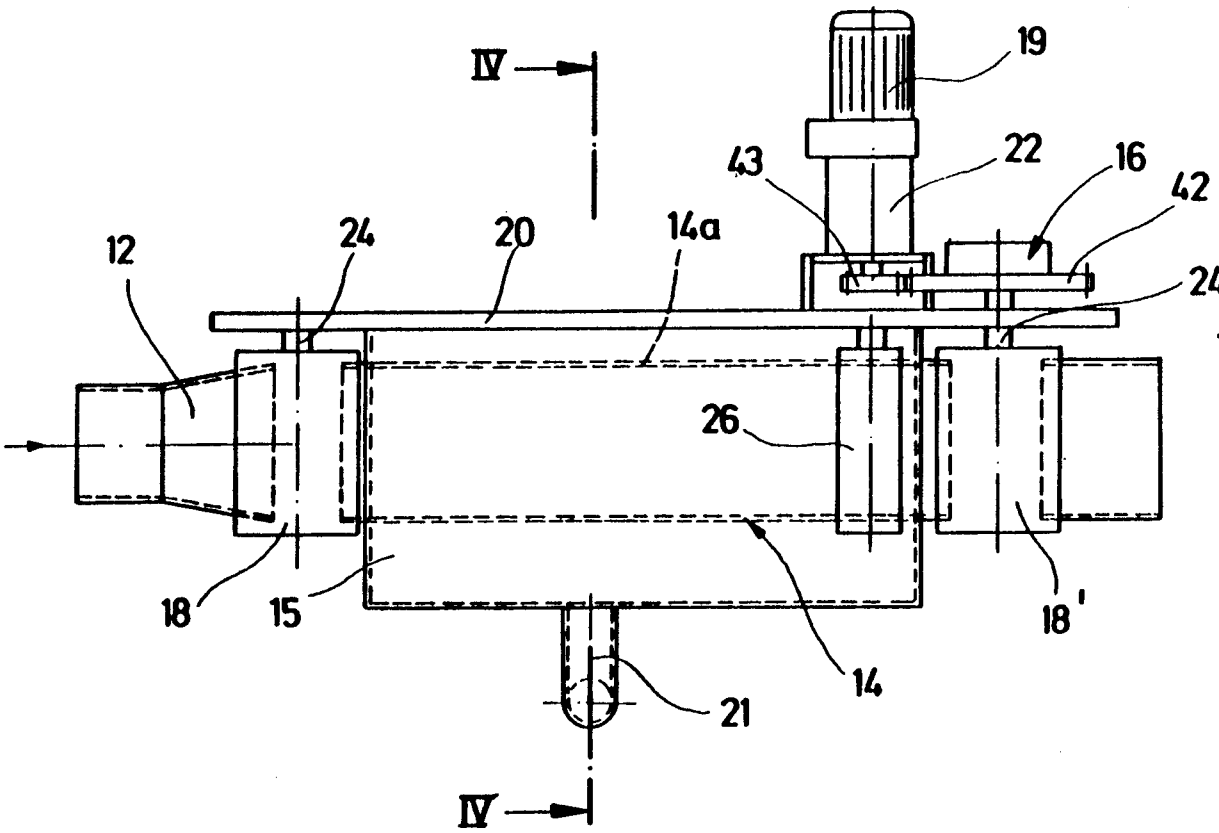
FIG. 3 is a lateral view of the sieve belt arrangement of FIG. 2, but with the covering and the bearing for the drive and the deflecting rollers.

It is shown in FIGS. 3 and 4 that the geometrical shape of the strand 5 can be reached in a simple manner because of the fact that the ends 3*a*, 4*a* of the sieve belts 3, 4 which face one another in the drainage area move through a guide duct 14 which is constructed as a pipe with a rectangular cross-section and with sieve walls 14*a*. The guide duct can be, for example, 2 m long, although this length is not decisive. This guide duct 14 is held in a vat 15 which is located under a bearing plate 20 and which, at its lowest point, is provided with a drain 21. The brine draining in the area of the gap 11 in the guide duct 14 and between the belt ends 3*a* and 4*a* may therefore be returned through the drain 21, in a manner not shown in detail, into the receptacles and thus into the operation.

The axes of rotation 23 and 24 of the four deflecting rollers 17, 17′ of sieve belt 3 or 18, 18′ of sieve belt 4 are also disposed at the bearing plate 20. In this case, the deflecting rollers 17′ and 18′ are driven and are arranged in a bearing 16 which also carries driving toothed wheels 42 which are connected to assigned pinions 43 of a transmission 22 which is driven by a motor 19. In this case, the arrangement of the pinions 43 and of the toothed wheels 42 is such that the rotating direction of the driven deflecting rollers 17' and 18' of the sieve belts 3 and 4 is opposite, but the driving speed is the same. The two belt ends 3*a* and 4*a* therefore move in the same direction and at the same speed. Between one another, they convey the strand 5 to the cutting station 6.

Figure 7:
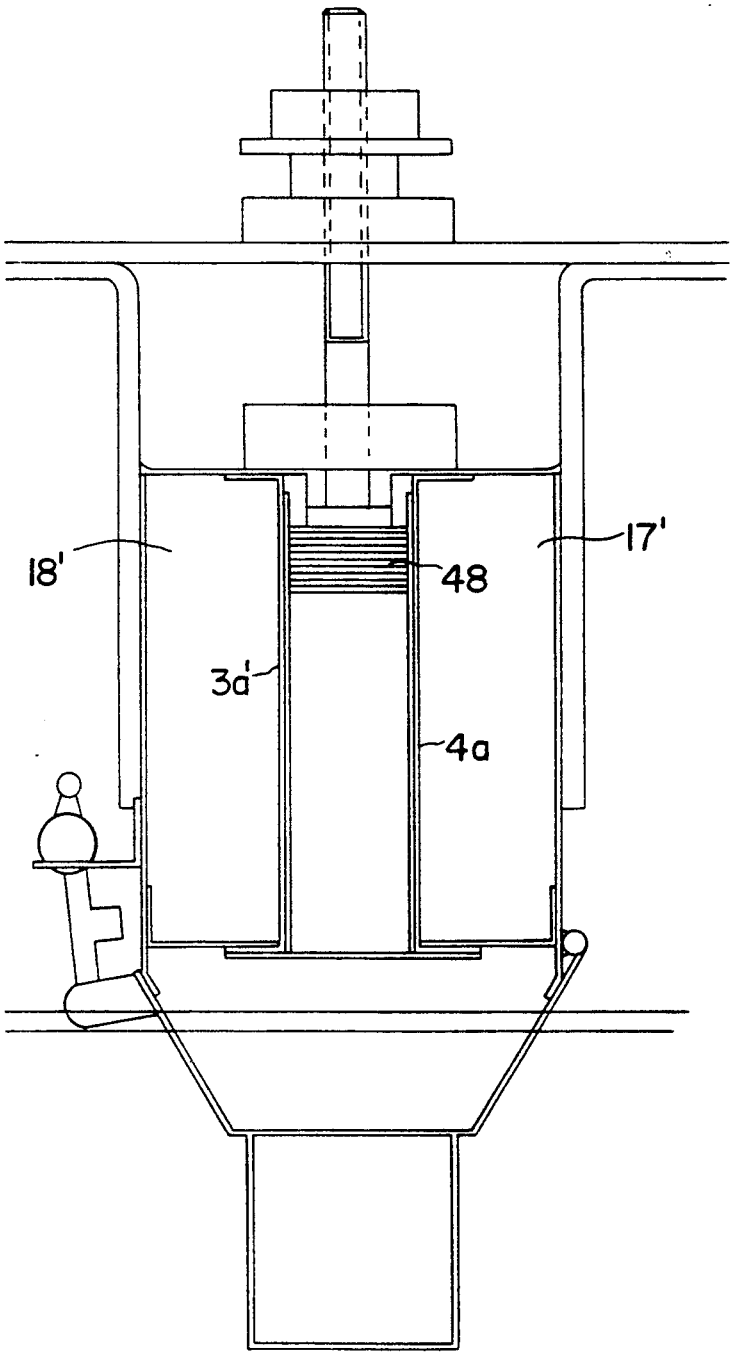
FIG. 7 is an end view of the sieve belt arrangement of FIG. 2.

In addition, both sieve belts 3 or 4 are equipped with tension rollers 25 and 26 which provide the sieve belts 3 and 4 with a constant tension. Also, as shown in FIG. 7, the sieve belt arrangement includes an adjustable covering 48 so that the height of the sieve belt is adjustable, between, for example, 12 and 18 cm.

Figure 5:
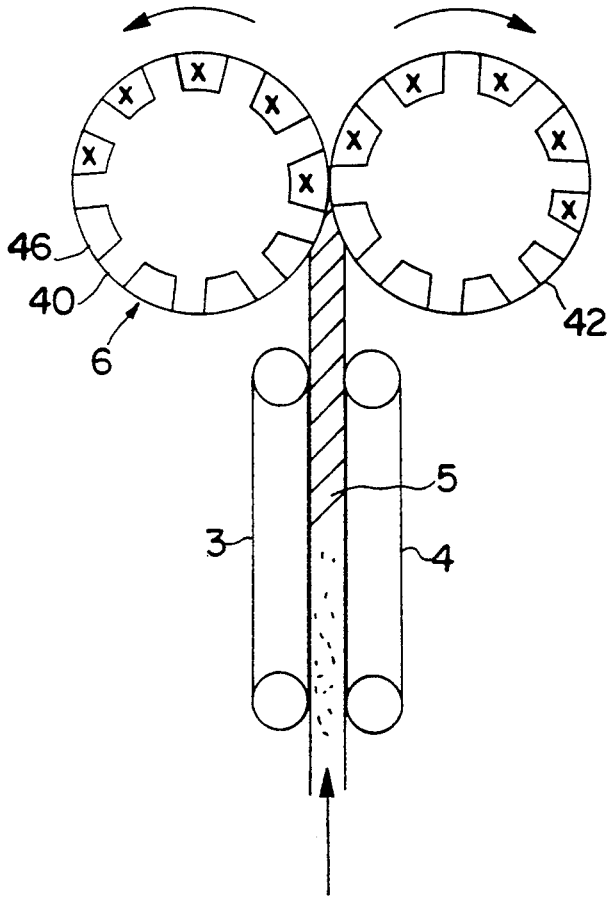
FIG. 5 is a top schematic view of a cutting arrangement.

At the end of the guide duct 14, the cutting station 6 cuts the strand 5. An exemplary embodiment of the cutting station 6 is illustrated in FIG. 5 and includes two cutting cellular wheels 40, 42. The cellular wheels 40, 42 are arranged such that each cell 46 at the contact point of the two cellular wheels 40, 42 is aligned with a tooth of the other cellular wheel so that the cells 46 are filled in portions.

Figure 6:
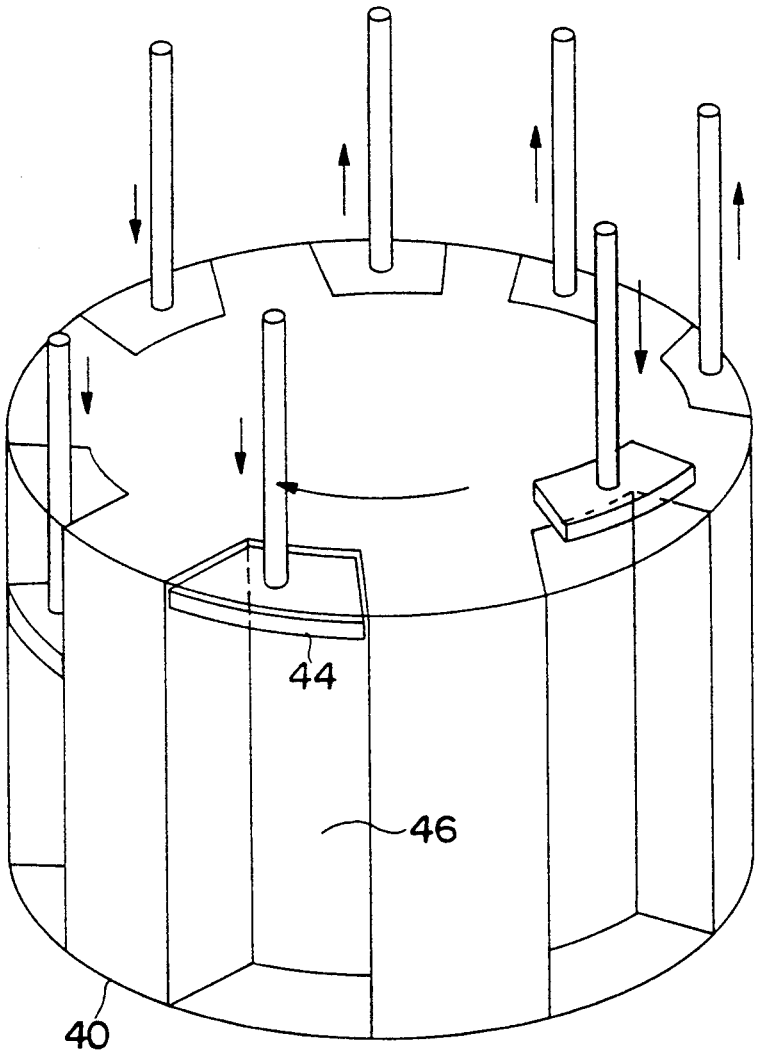
FIG. 6 is a perspection view of one of the cutters of the cutting arrangement of FIG. 5.

As seen in FIG. 6, each cell 46 has an associated piston 44 that rotates along with the cellular wheels 40, 42. During this rotation, the piston 44 ejects the filling of its cell 46 downward and then returns to its initial position. The filling is ejected into open cans (not illustrated) provided below the cellular wheels 40, 42.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Apparatus for preparing fibrous goods containing a liquid from a mixture of the fibrous goods and an additional liquid into a strand for apportioning and dispensing the fibrous goods, the apparatus comprising:

a draining device for draining the liquid from the mixture of the fibrous goods and the liquid, said draining device including two sieve belts which synchronously move through travel paths and which have parallel facing sections that form a gap for conveying the mixture of the fibrous goods and liquid while draining a portion of the liquid therefrom to form a fibrous goods strand that contains at least 50% by volume of the total liquid that was contained in the fibrous goods and had been mixed with the fibrous goods.

2. Apparatus according to claim 1, further comprising inlet guide means coupled to the draining device for guiding the mixture into the gap.

3. Apparatus according to claim 2, wherein the belts define an outlet end of the gap, the apparatus further comprising a cut-off device located at an outlet end of the gap and including means for cutting the strand.

4. Apparatus according to claim 3, further comprising:

mixing means for mixing the fibrous goods with the liquid, and conveying means including pumping means and guiding devices for conveying the fibrous goods and liquid mixture to the draining device.

5. Apparatus according to claim 1, wherein the belts define an outlet end of the gap, the apparatus further comprising a cut-off device located at the outlet end of the gap and including means for cutting the strand.

6. Apparatus according to claim 1, further comprising:

mixing means for mixing the fibrous goods with the liquid, and conveying means including pumping means and guiding devices for conveying the fibrous goods and liquid mixture to the draining device.

7. Apparatus according to claim 1, further comprising deflecting rollers for guiding the travel path of the sieve belts, the deflecting rollers having shafts at axes of rotation which are arranged vertically, the belts having ends which face one another to form the gap and which are arranged vertically.

8. Apparatus according to claim 7, further comprising a rectangular guide duct in which the belt ends move, and sieve walls.

9. Apparatus according to claim 8, further comprising a vat having a bearing plate, the guide duct being disposed inside the vat, the deflecting rollers having bearings which are received by the bearing plate.

10. Apparatus according to claim 9, wherein the vat includes a drain.

11. Apparatus according to claim 9, further comprising a drive for driving the deflecting rollers of the sieve belts, the drive including a motor and a transmission which are coupled to drive the shafts of the deflecting rollers of the two sieve belts respectively with a same rotational speed but in opposite directions.

12. Apparatus according to claim 1, wherein the sieve belts are respective continuous sieve belts, and further comprising two tension rollers, each tension roller engaging one of the continuous sieve belts.

13. Apparatus for preparing fibrous goods containing a liquid from a mixture of the fibrous goods and an additional liquid into a strand for apportioning and dispensing the fibrous goods, the apparatus comprising:

a draining device for draining the liquid from the mixture of the fibrous goods and the liquid, said draining device including two sieve belts which synchronously move through travel paths and which have parallel facing sections that form a gap for conveying the mixture of the fibrous goods and liquid while draining a portion of the liquid therefrom to form a fibrous goods strand that contains at least 50% by volume of the total liquid that was contained in the fibrous goods and had been mixed with the fibrous goods; and guide means coupled adjacently to the draining device for guiding the mixture into the gap solely by fluid pressure.

* * * * *